US005967110A

United States Patent [19]

Tsutsui et al.

[11] Patent Number: 5,967,110

[45] Date of Patent: Oct. 19, 1999

[54] FE-BASED SINTERED ALLOY MANUFACTURING PROCESS, FE-BASED SINTERED ALLOY MANUFACTURED THROUGH THEREOF AND BEARING CAP

[75] Inventors: Tadayuki Tsutsui; Bo Hu; Kei Ishii, all of Kashiwa; Hideo Shikata, Matsudo; Jun Sakai, Tokyo, all of Japan

[73] Assignee: Hitachi Powered Metals Co., Ltd., Chiba-ken, Japan

[21] Appl. No.: 09/065,277

[22] Filed: Apr. 23, 1998

[30] Foreign Application Priority Data

Apr. 25, 1997 [JP] Japan ..... 97/123513

[51] Int. Cl.[6] ..... F02F 7/00

[52] U.S. Cl. ..... 123/195 HC; 75/246; 419/11

[58] Field of Search ..... 419/11, 27, 35, 419/6; 75/246; 384/294, 295; 123/195 HC

[56] References Cited

U.S. PATENT DOCUMENTS

| | | | |
|---|---|---|---|
| 4,230,491 | 10/1980 | Behnke | 75/246 |
| 4,437,890 | 3/1984 | Hayasaka et al. | 419/27 |
| 4,561,889 | 12/1985 | Oaku et al. | 75/246 |
| 4,966,626 | 10/1990 | Fujiki et al. | 419/11 |
| 5,819,154 | 10/1998 | Hu et al. | 419/11 |

FOREIGN PATENT DOCUMENTS

| | | |
|---|---|---|
| 84/0248 | 7/1984 | European Pat. Off. . |
| 0257980 | 3/1988 | European Pat. Off. . |
| 90/12124 | 10/1990 | European Pat. Off. . |
| 4-342783 | 11/1992 | Japan . |
| 07305147 | 11/1995 | Japan . |
| 09241701 | 9/1997 | Japan . |
| 1 360 890 | 7/1974 | United Kingdom . |
| 2307917 | 6/1997 | United Kingdom . |

*Primary Examiner*—Noam Kamen
*Attorney, Agent, or Firm*—Scully, Scott, Murphy & Presser

[57] ABSTRACT

There is disclosed a method for manufacturing an Fe-based sintered alloy which is superb in machinability. This process comprises the steps of coating a paste-like coating agent including a compound of boron to a surface of a compact of Fe-based or Fe, Cu-based sintered alloy powder including carbon or a pre-sintered compact obtained by heating the compact at a diffusion temperature or less of carbon, and sintering a resultant compact or a pre-sintered compact at a diffusion temperature or more of carbon. An Fe-based sintered alloy manufactured through this process and a bearing cap made of such an Fe-based sintered alloy are also disclosed. In the invention, a film including a compound of boron and pyrolytic resin can be used instead of the paste-like coating agent.

14 Claims, 1 Drawing Sheet

FE-BASED SINTERED ALLOY MANUFACTURING PROCESS, FE-BASED SINTERED ALLOY MANUFACTURED THROUGH THEREOF AND BEARING CAP

BACKGROUND OF THE INVENTION

This invention relates to a process for manufacturing an Fe-based sintered alloy which is superb in machinability, and more particularly to a process for manufacturing an Fe-based sintered alloy which can be smoothly integrally machined together with such soft material as aluminum. Also, the present invention relates to an Fe-based sintered alloy manufactured through such a manufacturing process, and a bearing cap to be made using such an Fe-based sintered alloy.

An Fe-based sintered alloy is low in manufacturing cost and superb in properties such as strength, wear resistance, etc. For this reason, the Fe-based sintered alloy is used in a wide variety of technical fields. For example, mechanical parts made of an Fe-based sintered alloy, such as a valve driving system, a bearing, and the like, of automobiles, motorcycles, and the like are widely employed because a machining operation can be omitted considerably even for the parts having complicated configurations. However, since many of the mechanical parts made of an Fe-based sintered alloy are nevertheless required to be machined, poor machinability can still become a shortcoming involved in the conventional Fe-based sintered alloy.

In order to improve machinability of the Fe-based sintered alloy, many attempts have heretofore been made. In one attempt, iron powder containing sulfur is used as starting material powder. In another attempt, a sulfide is added to and mixed with starting material powder. In still another attempt, a compact is subjected to sulfidizing treatment in the atmosphere of hydrogen sulfide gas. In an attempt where sulfur as a free-cutting component is dispersed in a matrix of a sintered alloy, improvement of machinability is limited. Further, since sulfur is an element for decreasing strength, particularly toughness, of a sintered alloy and also for promoting corrosion of a sintered alloy, use of the sintered alloy is limited.

Another technique is also provided in which pores in a sintered alloy are filled with resin, or the like. In such a sintered alloy, since resin in the pores serves as an initiating point for chip breaking, chip breaking property is good. However, in such a technique, the kind of resin to be used can shorten the service life of a cutting tool such as a cutter. Moreover, the use of a sintered alloy sometimes requires a process for removing resin from the pores after the cutting operation.

In view of the above, in Japanese Patent Unexamined Publication (KOKAI) No. 79701/95, there is disclosed a technique in which boron nitride is used as a free-cutting component, instead of sulfur. According to this Publication, by adding boron nitride to a starting material power and mixing them together, frictional resistance between a sintered alloy and a cutting tool can be reduced and machinability can be enhanced. In Japanese Patent Unexamined Publication (KOKAI) No. 305147/95, there is disclosed a technique in which cubic boron nitride is added to and mixed with a starting material powder of an Fe-based sintered alloy. According to this Publication, boron nitride prevents diffusion of graphite, which is added as a starting material in a sintered alloy, and forming of pearlite, and promotes graphite to remain as free graphite, which is a cutting-free component.

Recently, aluminum alloy was widely used in parts of automobiles. For this reason, there are many occasions where Fe-based sintered alloy and aluminum alloy parts are integrally machined. Therefore, Fe-based sintered alloy is demanded to have the same degree of machinability as aluminum alloy. However, it is impossible to manufacture an Fe-based sintered alloy having such machinability even in accordance with the above proposed techniques. According to the teaching of the above proposed techniques, since powder for enhancing machinability is added to a starting material powder, the demand for enhancing the machinability of only the part of the sintered alloy which part is to be machined, cannot be satisfied.

With respect to this point, International Publication WO90/12124 and Japanese Patent Unexamined Publication No. 342783/92 disclose a technique in which the alloy surface is subjected to masking treatment when the alloy is subjected to carburizing treatment, so that carburizing is partly prohibited. However, the technique proposed in those Publications is directed to prevention of deterioration of toughness due to carburizing and therefore, such machinability as mentioned above is unobtainable.

SUMMARY OF THE PRESENT INVENTION

It is, therefore, an object of the present invention to provide a method for manufacturing an Fe-based sintered alloy capable of extensively improving machinability of a desired part of an Fe-based sintered alloy. It is also another object of the present invention to provide an Fe-based sintered alloy having such remarkably enhanced machinability and a bearing cap to be obtained using such an Fe-based sintered alloy.

From one aspect of the present invention, there is provided a method for manufacturing an Fe-based sintered alloy comprising the steps of coating a paste-like coating agent including a compound of boron onto (i) a surface of a compact of Fe-based or Fe, Cu-based sintered alloy powder including carbon or (ii) a pre-sintered compact obtained by heating the compact of (i) at or less than the diffusion temperature of carbon, and sintering the resultant compact or the pre-sintered compact at or higher than the diffusion temperature of carbon.

A coating agent is coated onto a compact of an Fe-based or Fe, Cu-based sintered alloy powder containing carbon and thereafter, the compact is sintered. By doing so, the coating agent is melted and permeated from the surface of the compact into gaps among particles. Since the boron compound contained in the coating agent prevents the carbon from diffusing when the compact is sintered, it becomes difficult for the carbon to be dissolved into the matrix of the sintered alloy. By this, generation of pearlite in the matrix is prevented, and as a result, a ferrite structure having a favorable machinability is generated. A pre-sintered compact obtained by sintering the compact at or less than the diffusion temperature of carbon is in a state where no pearlite is generated. Thus, by coating a coating agent onto the surface of this pre-sintered compact and then sintering the compact, the functions and effects similar to the above can also be obtained because the coating agent is melted and permeated from the surface of the pre-sintered compact into the inside thereof through pores.

The diffusion temperature or less of carbon for carrying out the temporary sintering is specifically 900° C. or less. The sintering is carried out by heating to about 1130° C. in a reducing atmosphere, for example. The coating agent may be coated (or applied) onto the entire surface of the compact or the pre-sintered compact. In that case, since it is only the surface layer portion of the sintered compact that prohibits dispersion of carbon, strength and other mechanical characteristics possessed by the Fe-based sintered alloy are not degraded. The coating agent may be coated onto only the part which is to be machined. In that case, such mechanical characteristics as wear resistance and resistance to permanent set in fatigue of the part coated with no coating agent are maintained.

Since a paste-like coating agent containing boron is employed in the manufacturing process of the present invention, the range of area coated with the coating agent can be clearly recognized and therefore, the area where machinability should be enhanced can be limited precisely. A large amount of coating agent is coated so that as large an amount of coating agent as possible can be permeated into the compact or the pre-sintered compact. In other words, by adjusting the thickness of the coating agent, the amount of permeation of the coating agent, namely, the depth of the free-cutting layer where machinability is enhanced, can be controlled. The paste portion of the coating agent can be produced by mixing a dispersing agent such as cellulose, CMC (carboxyl-methyl cellulose), vinyl acetate, acrylic resin, or the like into a solvent such as water, oil, carbitol, or the like. Then, by mixing about 50% by volume of at least one compound selected from the group consisting of boric acid, borax, and boron oxide (those compounds are hereinafter sometimes referred to as anti-diffusion agent(s)) to this paste portion, the coating agent containing boron can be produced.

Next, from the second aspect of the present invention, there is also provided a method for manufacturing an Fe-based sintered alloy comprising the steps of:

fixing a film including a compound of boron and pyrolytic resin onto a surface of (i) a compact of Fe-based or Fe, Cu-based sintered alloy powder including carbon or (ii) a pre-sintered compact obtained by heating the compact of (i) at or less than the diffusion temperature of carbon, and sintering the resultant compact or the pre-sintered compact at or higher than the diffusion temperature of carbon.

In this manufacturing process, functions and effects similar to those in the manufacturing process of the first aspect of the present invention can be obtained. In addition, there are the following advantages. It never happens that the coating agent is melted and flows on the surfaces of the compact and the pre-sintered compact when sintering, so that the coating agent is irregularly coated in thickness. Since the configuration of the film can be determined as desired, a free-cutting layer can be correctly formed in a desired range of the compact. It should be noted that the film can be fixed to the entire surfaces of the compact and the pre-sintered compact.

The component serving as a matrix of the film is a pyrolytic resin composed of at least one element selected from the group consisting of polyolefin-based resin, acrylic-based resin, polyester-based resin, polyamide-based resin, polyurethane-based resin, natural rubber, and synthetic rubber. Then, by mixing about 50% by volume of anti-dispersing agent composed of at least one compound selected from the group consisting of boric acid, borax, and boron oxide to the component of this matrix, a film containing boron can be manufactured. This film can be fixed to the surfaces of the compact and the pre-sintered compact through an adhesive agent composed of synthetic resin such as acrylic-based resin, rubber-based resin, epoxy-based resin, or the like.

From the third aspect of the present invention, there is provided a method for manufacturing an Fe-based or Fe, Cu-based sintered alloy comprising sintering a body formed by contacting a compact (hereinafter referred to as "compact A") of Fe-based or Fe, Cu-based sintered alloy powder containing 0.01 to 1.0% by weight of at least one compound selected from the group consisting of boric acid, borax, and boron oxide and 0.1 to 2.0% by weight of graphite powder with a compact (hereinafter referred to as "compact B") of Fe-based sintered alloy powder containing 0.1 to 2.0% by weight of graphite powder. For example, a cylindrical compact A is mated with a cylindrical compact B and then sintered to obtain a sintered compact in which the compact A is integral with the compact B. In the alternative, plate-like compacts A and B can be sintered in their superposed relation. In doing so, a more complicated configuration can be obtained.

From the fourth aspect of the present invention, there is also provided a method for manufacturing an Fe-based sintered alloy comprising the steps of compacting an Fe-based or Fe, Cu-based sintered alloy powder A containing 0.01 to 1.0% by weight of at least one compound selected from the group consisting of boric acid, borax, and boron oxide and 0.1 to 2.0% by weight of graphite powder with an Fe-based or Fe, Cu-based sintered alloy powder B containing 0.1 to 2.0% by weight of graphite powder into a body; and sintering the compact obtained by the preceding step. For example, a powder A is filled in a cavity of a die and a powder B is filled therein on the top of the powder A. In doing so, a compact can be obtained. In the alternative, a compact formed after compacting the powder A (or B) can be compacted together with the powder B (or A).

In the manufacturing processes from the third and fourth aspects of the present invention, the compacts A and B each contain 0.1 to 2.0% by weight of graphite powder. Dispersed as graphite in the matrix, the graphite acts as a solid lubricant and serves to improve machinability. On the other hand, the graphite acts such that carbon is diffused in the matrix so as to be dissolved therein, thus generating a pearlite structure which is hard and high in strength. The reason why 0.1% by weight or more of graphite is added to the starting material powder of the compacts A and B, is to precipitate a certain degree of pearlite in order to obtain a required strength. Particularly, with respect to the compact A, the above-mentioned amount of graphite is added in order to obtain an amount of undiffused graphite, so that machinability can be improved. And, according to the present invention, in order to obtain an amount of undiffused graphite, the above boron compound is added to the starting material powder of the compact A.

As a result of repeated hard study in order to obtain a sintered alloy in which graphite is dispersed by prohibiting the diffusion of carbon, the inventors have found out the fact that by adding the above boron compound to the starting material powder, a sintered alloy is obtained having a structure in which carbon from graphite is prevented from diffusing and graphite is dispersed in a mixed matrix of ferrite and pearlite. Then, as a result of quantitative analysis carried out based on this finding, it was known that if the addition of the boron compound is less than 0.01% by weight, the percentage of pearlite in the matrix is increased, thus resulting in insufficient improvement of machinability. It was also known that even if the boron compound is added in an amount exceeding 1.0% by weight, a further improvement of machinability cannot be obtained and in addition, the material strength is degraded because a large amount of boron oxide is dispersed. The above are the reasons why the compact A contains 0.01 to 1.0% by weight of boron compound.

The reason why the graphite content of the compact A is set to 2.0% by weight or less is to prohibit precipitation of pearlite by prohibiting dispersion of carbon within the limitation that the boron compound content should be 1.0% by weight or less. Similarly, the reason why the graphite content of the compact B is set to 2.0% by weight or less is to prevent the sintered alloy from becoming brittle by prohibiting precipitation of cementite. The powder of boron compound and graphite to be added to the starting material powder has an average particle size of 1 to 10 $\mu$m. In such a manufacturing process, by combining the compacts A and B such that a part of the sintered alloy which part is to be machined is constituted by the compact A, a sintered alloy which is superb in machinability and which is also superb in mechanical characteristic such as strength, or the like, can be manufactured.

In the manufacturing processes of the present invention so far described, an Fe-based sintered alloy a desired part of which can be extensively improved in machinability can be manufactured. Such an Fe-based sintered alloy is also one aspect of the present invention. If a bearing cap is manufactured using the Fe-based sintered alloy of the present invention, such a bearing cap is particularly well suited for an internal combustion engine. Such obtained bearing cap is also another aspect of the present invention. That is, a bearing cap according to another aspect of the present invention is constructed such that a semi-cylindrical bearing rotatably supporting a crankshaft of the internal combustion engine is fixedly secured to a cylinder block, and a part thereof contacting the bearing is less hard than the remaining part. In such a bearing cap, the part contacting the bearing is less hard than the remaining part and machinability is improved. Accordingly, machining for obtaining the degree of dimensional accuracy of the part contacting the bearing can be carried out easily.

From still another aspect of the present invention, there is provided a bearing cap for an internal combustion engine in which a semi-cylindrical bearing rotatably supporting a crankshaft of the internal combustion engine is fixedly secured to a cylinder block by bolts, wherein a part thereof contacting the bearing has HMV(Hardness Micro Vickers) 100 to 190 in hardness and a seat surface for the bolt has HMV200 to 600 in hardness.

In this bearing cap, the hardness of the part contacting the bearing is close to the hardness of the cylinder block made of aluminum alloy. Thus, the bearing cap and the cylinder block can be machined integrally. Since the bolt for fixing the bearing cap supports the reaction force of the crankshaft, a maximum stress acts on the bolt seat surface of the bearing cap and its nearby area. In the bearing cap of the present invention, since the hardness of that part is within the above-mentioned range of numerical values, permanent set in fatigue is small and performance can be maintained for a long period of time. It should be noted that although this bearing cap is preferably manufactured through the above-mentioned manufacturing process of the present invention, it can be manufactured through another manufacturing process.

DETAILED DESCRIPTION OF THE INVENTION

Figure 1:
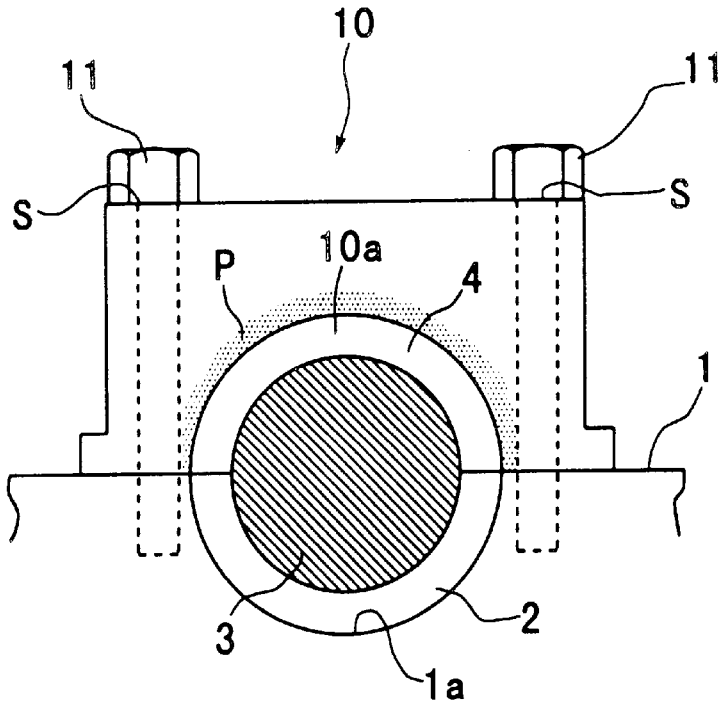
FIG. 1 is a front view showing one embodiment of a bearing cap of the present invention.

One embodiment of the present invention will be described hereinafter with reference to FIG. 1. In FIG. 1, reference numeral 10 denotes a bearing cap according to one embodiment of the present invention, and 1, a cylinder block of an engine of an automobile, respectively. A semi-circular recess 1*a* is formed in a side wall of the cylinder block 1. A semi-arcuate bearing 2 is fitted in this recess 1*a*. A crankshaft 3 is engaged with the bearing 2. A semi-arcuate bearing 4 is engaged with an upper half portion of the crankshaft 3. The bearing 4 is fixedly secured to the opposing bearing 2 by the bearing cap 10 through bolts 11.

A semi-spherical recess 10*a* engageable with the bearing 4 is formed in the bearing cap 10. This recess 10*a* is integrally finished together with the recess 1*a* of the cylinder block 1. That is, the cylinder block 1 is made of die-cast aluminum. In that state, a recess having a smaller diameter than the recess 1*a* is formed. On the other hand, the bearing cap 10 is an Fe-based sintered alloy. In the state after the sintering, a recess having a smaller diameter than the recess 10*a* is formed. The hardness of a portion P (indicated by dots in FIG. 1 and hereinafter referred to as "improved layer") covering a predetermined width from the inner peripheral surface of the recess is set to MHV 110 to 190 and the hardness of the remaining portion is set to MHV 200 to 600.

As shown in FIG. 1, with the bearing cap 10 fixedly secured to the cylinder block 1 by the bolts 11, a bore defined by two recesses is machined using an appropriate cutting tool to form recesses 1*a* and 10*a* having the same inside diameter. Thereafter, the bearing cap 10 is removed from the cylinder block 1, and the bearings 2 and 4, the crankshaft 3, and the bearing cap 10 are attached thereto.

In the bearing cap 10 thus constructed, the hardness of the portion P contacting the bearing 4 is close to the hardness of the cylinder block 1 made of aluminum alloy. Thus, the bearing cap 10 can be integrally machined together with the cylinder block 1. Since the bolts 11 for fixing the bearing cap 10 are adapted to support the reaction force of the crankshaft 3, a maximum stress acts on the bolt seat surface S of the bearing cap 10. Since the hardness of that portion is MHV 200 to 600 in the bearing cap 10 of the present invention, permanent set in fatigue is small and performance can be maintained for a long period of time.

In order to manufacture such a bearing cap 10 as mentioned above, a die in which the recess 10*a* is located in its under side is employed. Then, the arcuate portion of the improved layer P is preliminarily compacted using an Fe-based sintered alloy powder A containing 0.01 to 1.0% by weight of at least one element selected from the group consisting of boric acid, borax, and boron oxide, and 0.1 to 2.0% by weight of graphite powder. This powder compact is set onto a bottom portion of the die, and then, 0.1 to 2.0% by weight of an Fe-based sintered alloy powder B is filled therein on the top of the powder compact and compacted. The resultant powder compact is sintered. In the alternative, it is accepted that the arcuate portion of the improved layer P is preliminarily compacted using the powder A and the remaining portion is preliminarily compacted using the powder B, so that the two powder compacts can be sintered in their contacting relation. It is also an interesting alternative that the powder A is filled in the portion of the die forming the recess 10*a*, the powder B is then filled on the top of the powder A, and the resultant body is compacted. The improved layer P can be formed using a coating agent and film to be described hereinafter. Its process will be described hereinafter with reference to specific embodiments.

Embodiment 1

Six kinds of starting material powders were prepared at the mixing ratios shown in Table 1. After mixing for 30 minutes by a V-type mixer, the mixed powder was compacted to have a green density of 6.6 g/cm$^3$. By doing so, specimens of 32×12.5×10 mm were prepared. The respective specimens were heated in a reducing gas atmosphere of 690° C. By doing so, a pre-sintered compact was prepared. In Table 1, the zinc stearate is a lubricant for compacting powder, and the diffusion bonded powder refers to alloy powder which is pre-alloyed at the percentage contents shown in Table 1. Subsequently, three kinds of coating agents A to C shown in Table 2 were prepared. Those coating agents were coated onto the compact of the specimen No. 1 and also onto its pre-sintered compact such that 0.03 g of boron compound is contained per 1 cm$^2$. They were heated in a reducing gas atmosphere of 1130° C. and sintered.

TABLE 1

| Specimen No. | Cu powder | Ni powder | Mo powder | Graphite Zinc powder | stearate | Balance |
|---|---|---|---|---|---|---|
| 1 | 1.4 | — | — | 1.0 | 0.8 | Pure Fe powder |
| 2 | — | 3.0 | — | 1.0 | 0.8 | Pure Fe powder |
| 3 | 2.1 | 3.0 | — | 1.0 | 0.8 | Pure Fe powder |
| 4 | 1.4 | 3.9 | 0.5 | 1.0 | 0.8 | Diffusion bonded powder |
| 5 | — | — | — | 1.0 | 0.8 | 4600 alloy powder |
| 6 | — | — | — | 1.0 | 0.8 | 4100 alloy powder |

Note:
(1) Unit is % by weight
(2) 4600 alloy powder: Fe-2.0% Ni-0.5% Mo
(3) 4100 alloy powder: Fe-1.5% Cr-0.7% Mn-0.3% Mo

TABLE 2

| Coating agent | Boron compound | Chemical formula | Paste portion |
|---|---|---|---|
| A | Boron oxide | $B_2O_3$ | Water 96 vl. % - vinyl acetate 4 vl. % |
| B | Boric acid | $H_3BO_3$ | Oil 96 vl. % - acrylic resin 4 vl. % |
| C | Borax | $Na_2B_4O_7$ | Solvent 96 vl. % - Cellulose 4 vl. % |

Note: The boron compound content is 50 vl. %.

Then, the compact and its pre-sintered compact of the specimen No. 1 were sintered, the hardness of the portion coated with the coating agent was measured, and the thickness of the improved layer having 200 or less of MHV and improved machinability was also measured. The result is shown in Table 3. For the sake of comparison, the hardness of one sample obtained by sintering the compact of the specimen No. 1 coated with no coating agent was also measured. The result is also shown in Table 3.

TABLE 3

| Coating agent | State before sintering | Green density (g/cm$^3$) | Hardness (HRB) | Depth of improved layer |
|---|---|---|---|---|
| None | Compact | 6.54 | 68 | 0 |
| A | Compact | 6.59 | 54 | 0.7 |
| A | Pre-sintered compact | 6.57 | 35 | 1.7 |
| B | Compact | 6.62 | 57 | 0.7 |
| B | Pre-sintered Compact | 6.58 | 36 | 1.6 |
| C | Compact | 6.58 | 57 | 0.5 |
| C | Pre-sintered Compact | 6.57 | 43 | 1.1 |

As apparent from Table 3, the comparison with the one not coated with coating agent reveals that the hardness of those coated with any one of the coating agents was lowered considerably. The comparison of the respective coating agents reveals that the coating agent containing boron oxide is most effective. Moreover, it was also known that the pre-sintered compacts coated with coating agent are lower in hardness and larger in depth than the compacts coated with the coating agent. Thus it would be considered that the pre-sintered compacts are smaller in resistance than the compacts when the coating agent permeates therein.

Figure 2:
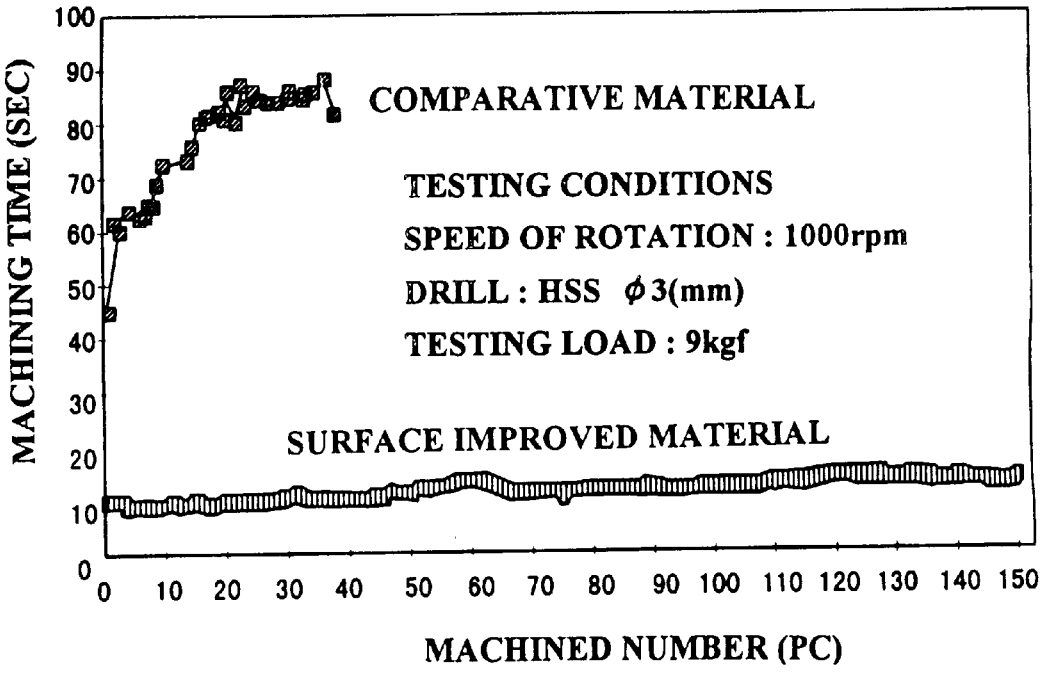
FIG. 2 is a chart showing the test result of the machinability of a sintered compact coated with a coating agent A in Embodiment 1 and a sintered compact coated with no coating agent.

Subsequently, a specimen (surface improved material) obtained by sintering the pre-sintered compact of the specimen No. 1 which pre-sintered compact was coated with the coating agent A and a specimen (comparative material) coated with no coating agent were drilled and the time required for the completion of the drilling was measured. The machining conditions and the machining result are shown in FIG. 2. As apparent from FIG. 2, with respect to the sintered alloy of the present invention, the machining time is remarkably shorter than that of the comparative material. Moreover, the machining time is unchanged even when a large number of drilling operations are carried out. On the other hand, with respect to the comparative material, wear of the drill occurs upon a small amount of machining as is apparent from the fact that the machining time is increased as the frequency of machining is increased.

Also, a compact of the bearing cap 10 of FIG. 1 was made from the specimen No. 1 and pre-sintered. Thereafter, the bearing cap 10 obtained by coating the coating agent A to the semi-circular recess and sintering the same was attached to the cylinder block 1. Then, the recess of the cylinder block 1 and the recess of the bearing cap were integrally machined. It was observed that they can be machined smoothly.

Embodiment 2

After the starting material powders of the specimen Nos. 1 to 6 shown in Table 1 were mixed for 30 minutes by a V-type mixer, the mixed powders were compacted into compacts having green densities of 6.6, 6.8, 7.0, and 7.2 g/cm$^3$, respectively. Then, a predetermined amount of the coating agent A of Table 2 was coated onto the surfaces of the compacts. Subsequently, the respective compacts were sintered under the same conditions as Example 1. Then, among the parts of the portions of the sintered alloys coated with the coating agent, the depth of the improved layers which were improved in machinability at 200 or less of MHV was measured. The result is shown in Table 4.

As is apparent from Table 4, with respect to the sintered alloys made from any one of the starting material powders, the desired depth of the improved layer could be obtained by sintering them after being coated with the coating agent. It was also observed that the depth of the improved layer is reduced because the permeability of the coating agent is lowered as the density of the compact is increased.

TABLE 4

| Green density ($g/cm^3$) | Depth of improved layer of 200 or less of MHV (mm) | | | | | |
|---|---|---|---|---|---|---|
| | Specimen No. 1 | Specimen No. 2 | Specimen No. 3 | Specimen No. 4 | Specimen No. 5 | Specimen No. 6 |
| 6.5 | 0.8 | 0.6 | 0.7 | 0.4 | 1.0 | 1.1 |
| 6.7 | 0.7 | 0.5 | 0.4 | 0.3 | 0.9 | 0.9 |
| 7.1 | 0.4 | 0.4 | 0.4 | 0.2 | 0.6 | 0.6 |
| 7.2 | 0.3 | 0.3 | 0.2 | 0.1 | 0.5 | 0.4 |

Embodiment 3

A compact having an inside diameter of 20 mm, an outside diameter of 30 mm and a height of 10 mm was prepared by compacting the starting material powder having the mixing ratio of the specimen No. 4 shown in Table 1 into a ring-shaped configuration. Then, the coating agent A was coated onto its outer peripheral surface and sintered in a reducing gas atmosphere of 1250° C. Then, the sintered compact was re-compressed at 500 MPa for sizing. Ten pieces of such compacts were prepared, and in addition ten pieces of sintered compacts were prepared under the same conditions as the above except that they were not coated with any coating agent. The outside diameter of the ten pieces of compacts was measured. Averages of the maximum values and the minimum values thereof are shown in Table 5.

As is apparent from Table 5, with respect to those which were sintered after being coated with the coating agent, the dimensional correction can easily be performed by means of sizing because the hardness of the outer peripheral portion is low. Moreover, they are remarkably small in the difference of the outside diameter compared with those coated with no coating agent. This means that those coated with the coating agent are high in degree of working and high in density at their working portion.

TABLE 5

| Coating of coating agent | Outside diameter (mm) | | Difference in outside diameter ($\mu m$) |
|---|---|---|---|
| | Max. value | Min value | |
| None | 29.930 | 29.990 | 60 |
| Coated | 29.911 | 29.933 | 22 |

Then, after the above-mentioned 20 pieces of sintered compacts were subjected to carburizing treatment by heating them at a temperature of 850° C. for 60 minutes in an atmosphere of 0.8% of a carbon potential value, they were quench hardened in oil at 60° C. Thereafter, they were temper hardened in an atmosphere of 180° C. The outside diameter of those sintered compacts was measured. Averages of the maximum values and the minimum values of the outside diameter thus measured are shown in Table 6. Also, the radial crush strength of each compact was measured. Averages of the measured values are also shown in Table 6.

TABLE 6

| Coating of coating agent | Outside diameter (mm) | | Difference in outside diameter ($\mu m$) | Radial crush strength (MPa) |
|---|---|---|---|---|
| | Max. value | Min. value | | |
| None | 29.938 | 30.011 | 73 | 1229 |
| Coated | 29.910 | 29.947 | 37 | 1349 |

As is apparent from Table 6, even in the sintered compact coated with the coating agent, the required mechanical strength can be obtained by dispersing carbon to the outer peripheral portion through carburizing treatment. Moreover, it should be underlined that a higher radial crush strength is obtained in the sintered compact coated with the coating agent than in the sintered compact not coated with coating agent because the outer peripheral portion is densified by sizing.

Embodiment 4

Three kinds of tape-shaped films A through C shown in Table 7 were prepared. Those three kinds of films A through C were obtained by mixing boron compound powder and polyester polymer at a volume ratio of 50:50 and thereafter, forming the mixture into the form of film by melt extrusion, and then applying an adhesive agent to one side thereof. The thickness of the film was set such that 0.03 g of boron compound is contained per 1 $cm^2$. Then, the respective films of Table 7 were adhered to the compact of the specimen No. 1 and its pre-sintered compact and sintered in a reducing gas atmosphere of 1130° C. Then, the hardness of the portion of each compact where the film was attached was measured. Also, the depth of the improved layer where machinability was improved at 200 or less of MHV was measured. The result is shown in Table 8. For the sake of comparison, the result, shown in Table 3, for the one obtained by sintering compact of the specimen No. 1 not coated with coating agent was also shown in Table 8. As is apparent from Table 8, in comparison with the one coated with the coating agent, the hardness of those using one of the films is lowered considerably. It is also observed that of the three films, the film A containing boron oxide is most effective. Furthermore, it is also observed that the pre-sintered compact attached with one of the films is lower in hardness and deeper in the improved layer than the powder compacts attached with one of the films.

TABLE 7

| Film | Boron compound | Chemical formula | Film matrix component |
|---|---|---|---|
| A | Boron oxide | $B_2O_3$ | Polyester polymer |
| B | Boric acid | $H_3BO_3$ | Polyester polymer |
| C | Borax | $Na_2B_4O_7$ | Polyester polymer |

TABLE 8

| Film | State before sintering | Green density ($g/cm^3$) | Hardness (HRB) | Depth of improved layer (mm) |
|---|---|---|---|---|
| None | Compact | 6.54 | 68 | 0 |
| A | Compact | 6.57 | 55 | 0.7 |
| A | T.S. compact | 6.58 | 35 | 1.7 |
| B | Compact | 6.61 | 58 | 0.6 |
| B | T.S. compact | 6.59 | 37 | 1.7 |

TABLE 8-continued

| Film | State before sintering | Green density ($g/cm^3$) | Hardness (HRB) | Depth of improved layer (mm) |
|---|---|---|---|---|
| C | Compact | 6.57 | 58 | 0.5 |
| C | T.S. compact | 6.57 | 45 | 1.3 |

Note: T.S. compact is pre-sintered compact.

Embodiment 5

Compact A comprising an improved layer was prepared by adding 0.8% by weight of zinc stearate as a lubricant at compacting to the starting material powder at the mixing ratios shown in Table 9 and then mixing them for 30 minutes by a V-type rotary mixer. In Table 9, for those specimens whose mixing ratios departed from the range of numerical limitation of the present invention, the numerical values are underlined. Also, a powder B was prepared by adding 0.8% by weight of zinc stearate to starting material powder having a mixing ratio of 99% by weight of pure iron powder, and 1% by weight of graphite powder, and then mixing them under the same conditions as above. The powder A was filled in a cavity of a die and the same quantity of powder B was filled therein on the top of the powder A. Then, the resultant body was compacted so as to have a configuration of 12.5×32×5.0 mm and a green density of 6.7 $g/cm^3$. Then the compact thus obtained was sintered for 60 minutes in nitrogen (in dissociated ammonium gas) containing 75% by weight of hydrogen at a temperature of 1130° C., and then was cooled to room temperature. As a result, compacts of the specimen No. 10 to 16 were obtained. Then, the depth of the improved layer was measured by taking a microscopic photograph of each compact. The particle diameter of the powder used was: 50 μm for the iron powder on average, 2 μm for the boron oxide powder on average, and 5 μm for the graphite powder on average.

TABLE 9

| Specimen N0. | Pure iron powder wt.% | Boron oxide wt.% | Graphite wt.% | Depth of improved layer mm |
|---|---|---|---|---|
| 10 | 99.88 | 0.02 | 0.1 | 1.4 |
| 11 | 98.5 | 0.5 | 1.0 | 2.0 |
| 12 | 97.0 | 1.0 | 2.0 | 2.4 |
| 13 | 99.0 | 0.005 | 1.0 | o |
| 14 | 97.9 | 1.2 | 0.1 | 2.4 |
| 15 | 99.5 | 0.5 | 0.05 | 2.4 |
| 16 | 97.4 | 0.5 | 2.1 | 0 |

In the specimens Nos. 10 to 12, the boron oxide and graphite contents of the powder A of which are within the scope of the present invention, it was confirmed from the microscopic photographs that an improved layer formed on the powder A portion, the layer having a structure in which undiffused graphite was dispersed in a matrix of ferrite and pearlite. Also, in the specimen Nos. 10 to 12 it was observed that the depth of the improved layer is reduced because the carbon of the powder B can not be prevented from diffusing towards the improved layer as the boron oxide content is reduced. On the other hand, in the specimen No. 13 in which the boron oxide content is smaller than the scope of the present invention, the powder A portion became a structure of pearlite because diffusion of the carbon from the graphite cannot be prevented. In the specimen No. 14 the boron oxide content of which is larger than the scope of the present invention, although a improved layer was formed, it can be anticipated that the strength is decreased because a large amount of boron oxide exists in the matrix.

In the specimen No. 16, the graphite content of which is larger than the scope of the present invention, the powder A portion became a structure of pearlite because excessive carbon diffused. In the specimen No.15, the graphite content of which is smaller than the scope of the present invention, it can be anticipated that the property of the solid lubrication is degraded and machinability is degraded because the amount of free graphite is small.

In the manufacturing process of the present invention described hereinbefore, since the diffusion of carbon from graphite as a starting material is prevented and machinability is enhanced and in addition, a suitable amount of pearlite exists, an Fe-based sintered alloy capable of maintaining strength can be manufactured.

Obviously, numerous modifications and variations of the present invention are possible in light of the above teachings. It is therefore to be understood that within the scope of the appended claims, the invention may be practiced otherwise than as specifically described herein.

What is claimed is:

1. A method for manufacturing an Fe-based sintered alloy comprising:

coating a paste-like coating agent including a compound of boron onto a surface of (i) a compact of Fe-based or Fe, Cu-based sintered alloy powder including carbon or (ii) a pre-sintered compact obtained by heating said compact of (i) at or less than the diffusion temperature of carbon, and sintering the resultant compact or the resultant pre-sintered compact at or higher than the diffusion temperature of carbon.

2. A method for manufacturing an Fe-based sintered alloy according to claim 1, wherein said compound of boron includes at least one compound selected from the group consisting of boric acid, borax, and boron oxide.

3. A method for manufacturing an Fe-based sintered alloy according to claim 2, wherein said paste-like coating agent is coated to a part of the surface of said compact or said pre-sintered compact.

4. An Fe-based sintered alloy manufactured by a manufacturing process according to claim 1.

5. A bearing cap for an internal combustion engine made of an Fe-based sintered alloy according to claim 4, wherein a semi-cylindrical bearing rotatably supporting a crankshaft of said internal combustion engine is fixedly secured to a cylinder block, and the hardness of a part thereof contacting said bearing is lower than that of the remaining part.

6. A method for manufacturing an Fe-based sintered alloy comprising:

fixing a film including a compound of boron and pyrolytic resin onto a surface of (i) a compact of Fe-based or Fe, Cu-based sintered alloy powder including carbon or (ii) a pre-sintered compact obtained by heating said compact of (i) at or less than the diffusion temperature of carbon, and sintering the resultant compact or the pre-sintered compact at or higher than the diffusion temperature of carbon.

7. A method for manufacturing an Fe-based sintered alloy according to claim 6, wherein said compound of boron includes at least one compound selected from the group consisting of boric acid, borax, and boron oxide.

8. A method for manufacturing an Fe-based sintered alloy according to claim 7, wherein said film is fixed to a part of the surface of said compact or said pre-sintered compact.

9. An Fe-based sintered alloy manufactured by a manufacturing process according to claim 6.

10. A bearing cap for an internal combustion engine made of an Fe-based sintered alloy according to claim 9, wherein a semi-cylindrical bearing rotatably supporting a crankshaft of said internal combustion engine is fixedly secured to a cylinder block, and the hardness of a part thereof contacting said bearing is lower than that of the remaining part.

11. A method for manufacturing an Fe-based sintered alloy comprising sintering a body formed by contacting a compact of Fe-based or Fe, Cu-based sintered alloy powder containing 0.01 to 1.0% by weight of at least one compound selected from the group consisting of boric acid, borax, and boron oxide and 0.1 to 2.0% by weight of graphite powder with a compact of Fe-based or Fe, Cu-based sintered alloy powder containing 0.1 to 2.0% by weight of graphite powder.

12. A method for manufacturing an Fe-based sintered alloy comprising:

compacting a blend of Fe-based or Fe, Cu-based sintered alloy powder containing 0.01 to 1.0% by weight of at least one compound selected from the group consisting of boric acid, borax, and boron oxide and 0.1 to 2.0% by weight of graphite powder with a blend of Fe-based or Fe, Cu-based sintered alloy powder containing 0.1 to 2.0% by weight of graphite powder into a body without mixing said powders with each other; and sintering the compact obtained by the preceding processes.

13. A method for manufacturing an Fe-based sintered alloy comprising:

preparing an Fe-based or Fe, Cu-based sintered alloy powder containing 0.01 to 1.0% by weight of at least one compound selected from the group consisting of boric acid, borax, and boron oxide and 0.1 to 2.0% by weight of graphite powder and an Fe-based or Fe, Cu-based sintered alloy powder containing 0.1 to 2.0% by weight of graphite powder and compacting one of said powders;

compacting the compact obtained by the preceding processes with the remaining powder; and sintering the compact obtained by the preceding processes.

14. A bearing cap for an internal combustion engine in which a semi-cylindrical bearing rotatably supporting a crankshaft of said internal combustion engine is fixedly secured to a cylinder block by a bolt, wherein a part thereof contacting said bearing has HMV100 to 190 in hardness and a seat surface for said bolt has HMV200 to 600 in hardness.

* * * * *

UNITED STATES PATENT AND TRADEMARK OFFICE

CERTIFICATE OF CORRECTION

PATENT NO. : 5,967,110
DATED : October 19, 1999
INVENTOR(S) : T. Tsutsui et al.

It is certified that error appears in the above-identified patent and that said Letters Patent is hereby corrected as shown below:

Title page,
Item [56], References Cited, FOREIGN PATENT DOCUMENTS,
"84/0248 07/84 EPO" should read -- 84/0248 7/84 PCT --.
"90/12124 10/90 EPO" should read -- 90/12124 10/90 PCT --

Column 7,
Lines 26 to 28, Table 1: "Graphite Zinc powder" should read -- Graphite powder --
Line 28, Table 1: "stearate" should read -- zinc stearate --

Signed and Sealed this

Sixteenth Day of July, 2002

*Attest:*

*Attesting Officer*

JAMES E. ROGAN
*Director of the United States Patent and Trademark Office*

UNITED STATES PATENT AND TRADEMARK OFFICE

CERTIFICATE OF CORRECTION

PATENT NO. : 5,967,110
DATED : October 19, 1999
INVENTOR(S) : Tadayuki Tsutui et al.

It is certified that error appears in the above-identified patent and that said Letters Patent is hereby corrected as shown below:

Title page,
Item [73], "Powered" should read -- Powdered --

Signed and Sealed this

Fifteenth Day of April, 2003

JAMES E. ROGAN
*Director of the United States Patent and Trademark Office*